United States Patent [19]

Balon

[11] 4,135,378

[45] Jan. 23, 1979

[54] WIRE FEEDING MEANS

[75] Inventor: Gary D. Balon, Hummelstown, Pa.

[73] Assignee: AMP Incorporated, Harrisburg, Pa.

[21] Appl. No.: 745,331

[22] Filed: Nov. 26, 1976

[51] Int. Cl.[2] ..... B21D 43/02; B21D 43/09

[52] U.S. Cl. ..... 72/14; 72/21; 72/421; 83/222; 29/709

[58] Field of Search ..... 29/709, 712; 72/14, 72/15, 21, 421; 83/208, 222, 367, 370, 417, 365; 214/1 PE, 1 C, 1 MD, 1 F

[56] References Cited

U.S. PATENT DOCUMENTS

| | | | |
|---|---|---|---|
| 3,245,135 | 4/1966 | Netta et al. | 29/630 A |
| 3,439,517 | 4/1969 | Munchbach | 72/11 |
| 3,556,368 | 1/1971 | René | 83/208 |
| 3,707,255 | 12/1972 | Ridgway et al. | 83/208 |
| 3,810,406 | 5/1974 | Peddinghaus | 83/222 |
| 3,814,145 | 6/1974 | Gott | 140/112 |
| 3,830,121 | 8/1974 | Makeev et al. | 83/417 X |
| 3,967,518 | 7/1976 | Edwards | 83/365 X |

*Primary Examiner*—C. W. Lanham
*Assistant Examiner*—D. M. Gurley
*Attorney, Agent, or Firm*—Frederick W. Raring

[57] ABSTRACT

Feeding apparatus for feeding material for a predetermined distance past a predetermined point on a feed-path comprises a pair of feed rollers, one of which is coupled to a stepping motor. A sensing means in the form of a light beam is provided on the feeding path at the predetermined point and when the material being fed intersects and interrupts this light beam, a control means for the stepping motor commences to count pulses transmitted to the motor. After a number of pulses have been counted which causes the motor to feed the material precisely to the predetermined location, the motor is stopped. The control means also has means for actuating a further apparatus (such as a crimping press) which performs an operation on the material. This control means is effective to delay energization of the crimping press is the press is not in a state of readiness for performing the crimping operation.

3 Claims, 14 Drawing Figures

2
4
6

24
20
26
30
28
40
228
55
234
154
20
6
8
16
6
6
22
36

Fig. 9
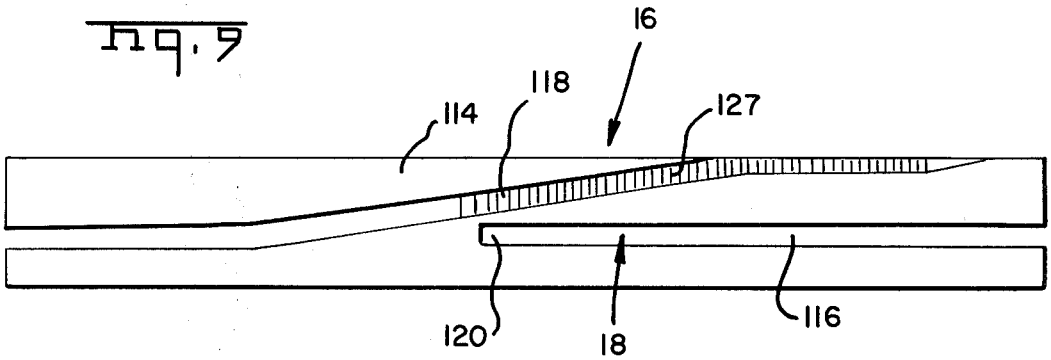
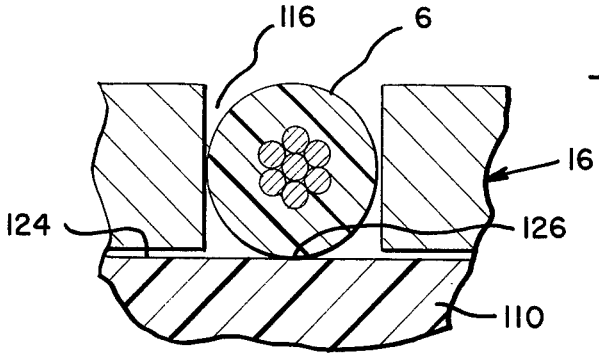
Fig. 10
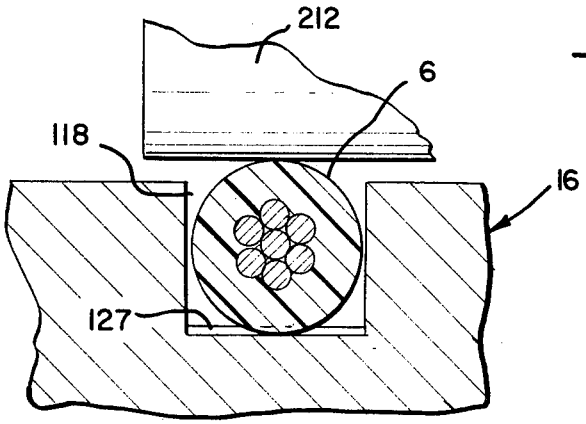
Fig. 11

WIRE FEEDING MEANS

BACKGROUND OF THE INVENTION

This invention relates to feeding means for feeding material for a precise distance past a fixed point on a feed path and for energizing an associated apparatus which performs an operation on the material which has been fed. The invention is herein disclosed in conjunction with a lead making machine which transports individual wires to a crimping press which functions to crimp the terminal onto the end of each wire presented thereto. It will be understood, however, that the principles of the invention can be used for feeding other materials and in conjunction with other types of apparatus for performing operations on the fed material.

Application Ser. No. 723,697 discloses and claims a lead making machine which serially applies terminals to the ends of each of a succession of wires which are presented to a crimping press which forms part of the machine. In accordance with the principles of the invention described in Application Ser. No. 723,697 the wires are transported laterally of their axes until they are positioned in axial alignment with, but spaced from, the crimping press. Thereafter, the wires are fed axially until the leading end of each wire is located between the die and anvil of the press. The press is then actuated to crimp terminals onto the end of the wire. It is essential that the end of the wire be precisely positioned between the die and anvil if satisfactory electrical leads are to be produced by machines of this general class. The instant invention provides a means for feeding the wires axially past a predetermined point on the wire feed path so that its end is precisely and accurately located between the die and anvil. Precise feeding of the wire is achieved by virtue of the fact that the feed rolls are driven by a stepping motor which is controlled by control circuit means as will be described below. During axial feeding of the wire, it interrupts a light beam thereby to cause a signal to be sent to the control means and upon receipt of this signal, the control means causes the stepping motor to be rotated through a precisely predetermined arc and thereby feed the wire beyond the light beam by a precisely predetermined amount. The amount by which the wire is fed can be readily changed by merely changing some switch settings so that the performance of the apparatus can be precisely controlled. The control means also incorporates means for actuating the crimping press after the wire has been fed. Additionally, means are provided for delaying actuation of the press after the wire has been fed if the press is not in a state of readiness to carry out the crimping operation; in other words, if the press has not completed its previous operating cycle.

It is accordingly an object of the invention to provide an improved feeding means for feeding material, such as wire, for a precise distance beyond a predetermined point on the feed path. A further object is to provide feeding means and control means for a lead making machine including means for actuating the crimping press of the machine after conclusion of the wire feeding step. A further object is to provide a feeding means having switch means controlling the length of material is fed. A further object is to provide a relatively simple and durable feeding means for materials such as wire which can be used in conjunction with a wide variety of apparatus for performing operations on the material being fed.

These and other objects of the invention are achieved in a preferred embodiment thereof which is briefly described in the foregoing abstract, which is described in detail below, and which is shown in the accompanying drawing in which:

FIG. 9 is a view showing the developed surface of the wire conveying and feeding drum.

FIGS. 10 and 11 are fragmentary views illustrating the operation of the wire conveying and feeding drum.

Figures 1, 1A:
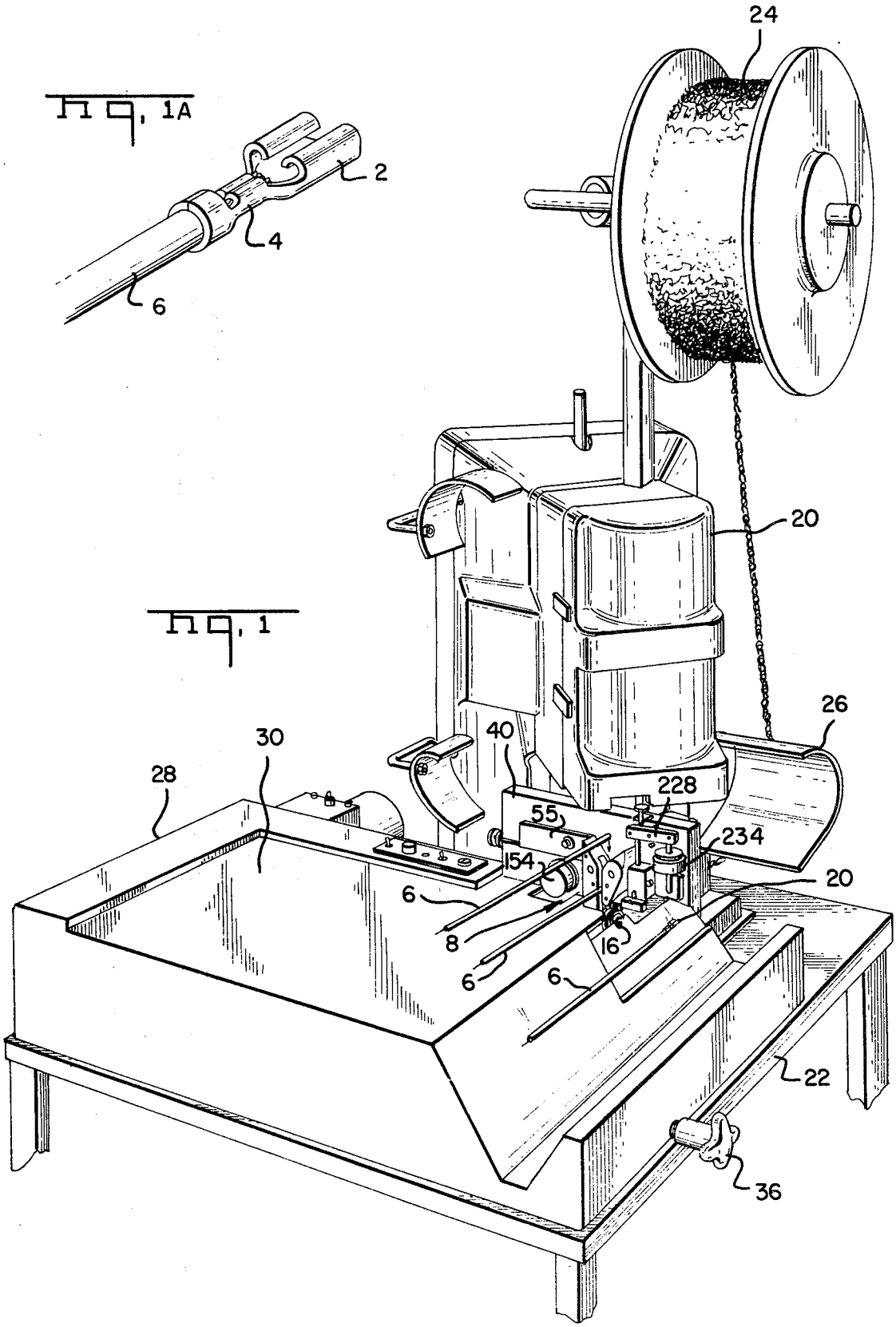
FIG. 1 is a perspective view of a lead making machine having a feeding means in accordance with the invention.
FIG. 1A is a perspective view of a terminated wire produced by the disclosed embodiment of the invention.

A feeding means in accordance with the invention is disclosed herein in conjunction with the apparatus shown in FIG. 1 which presents wires 6 to a crimping press at which a terminal is crimped onto the end of each wire. Since an understanding of the apparatus shown in FIG. 1 is desirable for appreciation of the principles of the instant invention, the apparatus will first be described.

Figure 2:
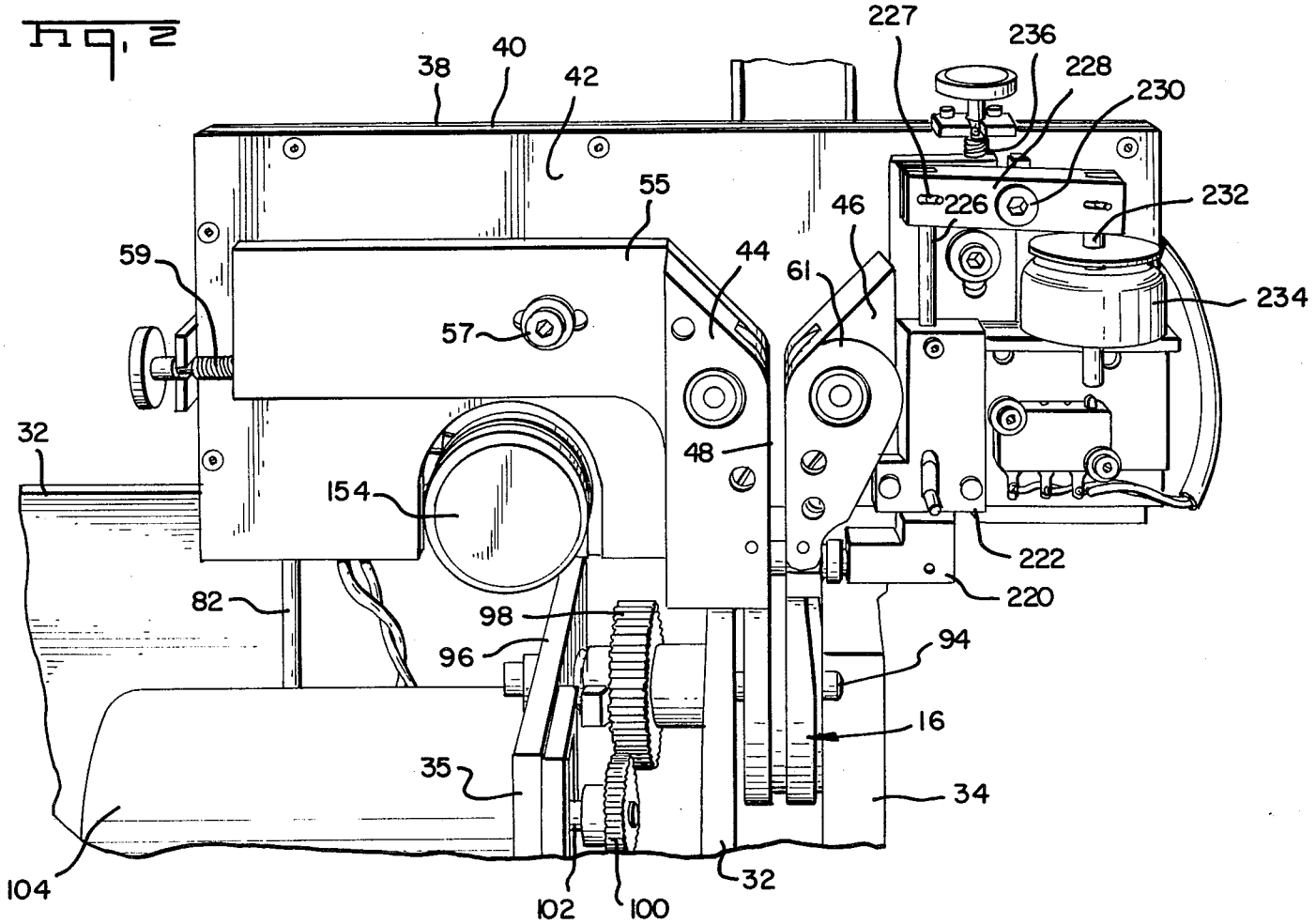
FIG. 2 is a fragmentary frontal view showing the wire loading station, the wire feeding station, the wire conveying and feeding drum, and related structural features.
Figure 3:
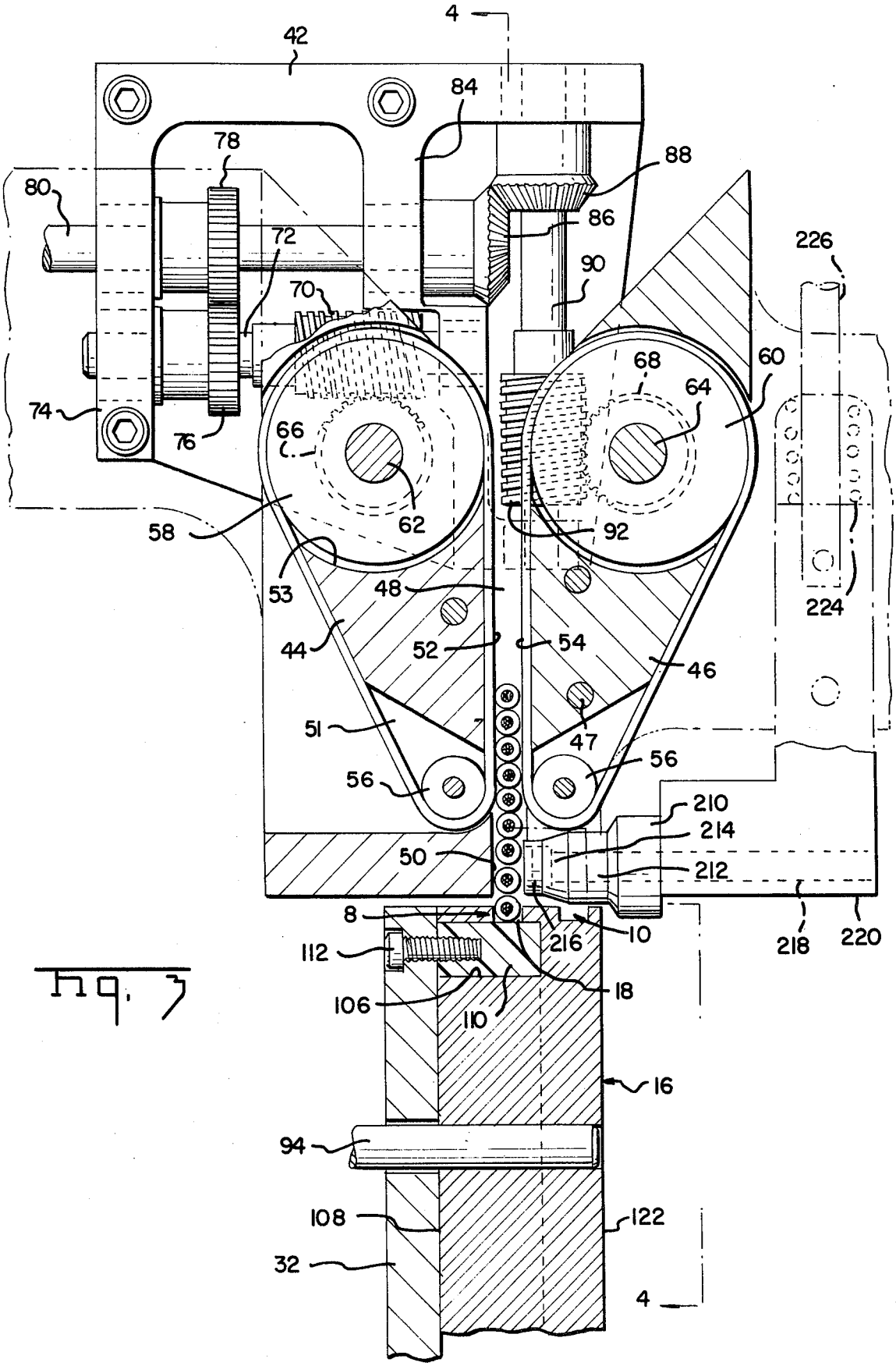
FIG. 3 is a fragmentary frontal view, on an enlarged scale and partially in section, of the central portion of FIG. 2.
Figure 4:
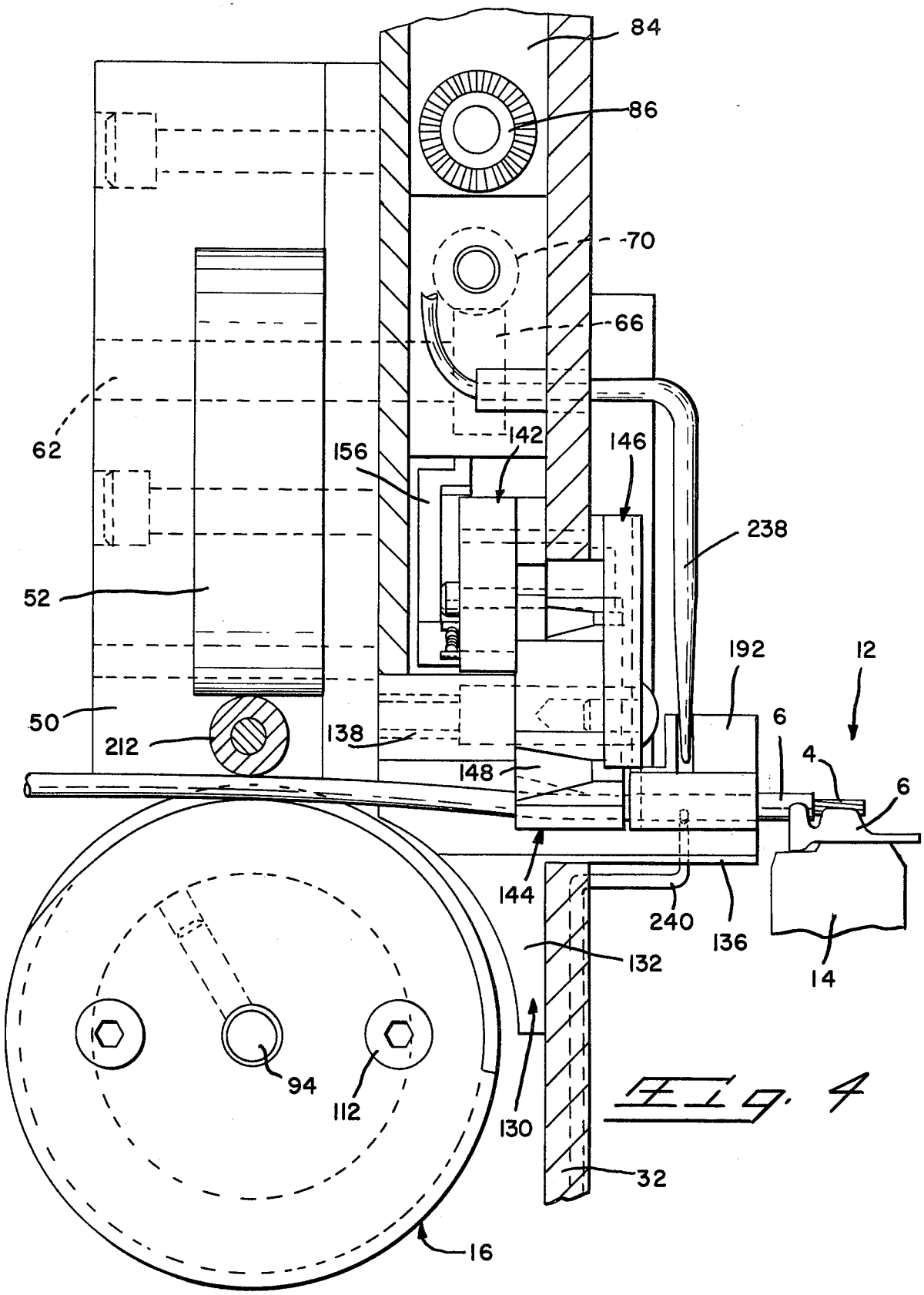
FIG. 4 is a view taken along the line 4—4 of FIG. 3.

The essential motions which are imparted to the wires by the apparatus are shown in FIGS. 2–4, the operator stacks the wires in a slot 48 at a loading station 8 (FIG. 3) and the wires are individually removed from the bottom of the stack and conveyed laterally to a wire feeding station 10. The lateral conveyance and axial feeding of each wire is carried out by a cylindrical conveying and feeding drum 16 which rotates continuously during operation. The wire is fed axially at the feeding station 10 to an operating zone 12 (FIG. 4) and the stripped end 4 is located in alignment with the terminal which is disposed on an anvil 14. Finally, the terminal is crimped onto the wire by a crimping die 15 (FIG. 5) and the terminated wire is ejected from the apparatus.

Referring now to FIG. 1, the apparatus comprises a conventional bench press 20 mounted on a suitable support surface 22 and having a terminal applicator (not specifically shown) mounted on its platen. The ram of the terminal applicator is connected to the press ram and the crimping die 15 is mounted on the applicator ram. Terminals in strip form 24 are fed from a reel over a guide plate 26 to the applicator to position the leading terminal of this strip on the anvil as shown in FIG. 4 in accordance with conventional practice.

A housing 28 for the control circuitry and the motors of the apparatus is also supported on the support 22 and this housing has sidewalls and internal walls as shown at 32, 34, 35 on which various parts of the apparatus are mounted and supported as will be described below. The upper surface 30 of the housing 28 serves as a work surface for the operator and as a support for wires which are being serially fed into the machine by the operator. Advantageously, the casing 28 is provided with adjusting means 36 so that it can be raised and lowered relative to the surface 22 and the press 20 can similarly be adjusted so that the conveyed and fed wires will be properly positioned above the anvil 14 after the wires are axially fed.

The casing backwall 32 (FIG. 2) extends upwardly and rightwardly as viewed in FIG. 2 and as shown at 38. A spacer member 40 is secured against the face of the plate section 38 and a cover plate 42 is secured by fasteners as shown to this spacer. The loading means for loading wires onto the drum 16 is mounted on the cover plate 42 and drive shafts and other parts of the apparatus are supported on the plate section 38 and the cover plate.

The loading station 8 comprises left and right hand block assemblies 44, 46 mounted on the plate 42 which are spaced apart to define the vertically extending guide slot 48 for the wires as shown in FIG. 3. While the wires may fall downwardly in this slot under gravitational forces, it is desirable to provide endless belts 42, 44 which are continuously driven downwardly as viewed in FIG. 3 to ensure that a jammed wire does not impede the downward movement of the wires to the conveying and feeding drum 16. These belts also serve to compact the wires in the slot and thereby ensure that a wire will enter the conveying drum or wheel 16 as will be described below. Belt 52 on block 44 extends over a drive pully 58, downwardly on the left hand side of the slot, over an idler pully 56 in the lower portion of the block 44 and back to the drive pully 58. Drive pully 58 is secured, as by keying, to a shaft 62 which extends rearwardly through the cover plate 42 to the plate section 38. Shaft 62 has a gear 66 thereon which meshes with a worm gear 70 on a horizontally extending shaft 72 which extends leftwardly as viewed in FIG. 3 and has its end journaled in an arm 74 of the spacer member 42. Shaft 70 has a spur gear 76 thereon which meshes with another spur gear 78 mounted on a main drive shaft 80. The drive pully and the idler 56 are disposed in suitable recess in the block 44 as shown at 51 and 53.

The right hand block 46 has a drive pully 66 therein mounted on a shaft 64 which drives the belt 54 downwardly, around an idler 56 and back to the pully 60. The shaft 64 on which the pully 60 is mounted has a spur gear 68 mounted thereon which meshes with the worm gear 92 on a vertically extending jack shaft 90 which is journaled at its upper end in the spacer member 42. A bevel gear 88 on shaft 90 meshes with a bevel gear 86 on the previously mentioned horizontally extending main power shaft 80. The main power shaft is driven by a suitable fractional horsepower motor to which it is coupled through bevel gears by a vertically extending shaft 82 (FIG. 2). It will be apparent from an inspection of FIG. 3 that during continuous rotation of the shaft 80, the pullies 58, 60 will be driven continuously and the portions of the belts 52, 54 which are on each side of the slot 48 will move downwardly continuously.

The wire loading slot 48 extends through the lower portion of the block 44 as shown at 50 and clearance is provided on the right hand side of the slot 48 at its lower end to permit the wires to move downwardly so that the lowermost wire will be properly located and fall into a groove 18 in the surface of the drum 16 which will be described below. It should be noted at this point that the upper ends of the blocks 44, 46 have divergent surfaces so that the operator can load wires into the slot 48 by merely placing them between the blocks and against one of these surfaces. The belts will then ensure that the wires will move downwardly and form the stack shown in FIG. 3.

Advantageously, the block 44 is adjustably mounted for horizontal movement towards and away from the block 46 so that the width of the slot 48 which receives the wires can be adjusted. In the disclosed embodiment the block 44 is mounted on a mounting plate 55 which is secured by a bolt 57 to the plate 42. The bolt extends through an elongated slot in the plate 55 so that the mounting plate and the block 44 can be moved rightwardly and leftwardly for adjustment purposes as viewed in FIG. 2. An adjusting screw 59 may be provided to permit precise positioning of the mounting plate.

The block 46 is provided with a cover plate 61 and the lower end of this block is recessed to provide clearance for a pressure roll 210 described below.

The feed drum 16 is mounted on a shaft 94 which extends between two parallel fixed plates 32, 35 which form portions of the housing. A gear 98 (FIG. 2) is secured to the shaft 94 between the plates 32, 35 and this gear meshes with a gear 100 on the output shaft 102 of a stepping motor 104.

As shown best in FIG. 3, a circumferential recess 106 extends concentrically into the side 108 of the feed drum 16 which is against the rightwardly facing surface of the plate 32. This recess receives a ring 110 of plastic or other low friction material and the ring in turn is secured to the surface of the plate 32 by suitable fasteners 112. The feed wheel 16 thus rotates on the fixed ring 110.

Figure 8:
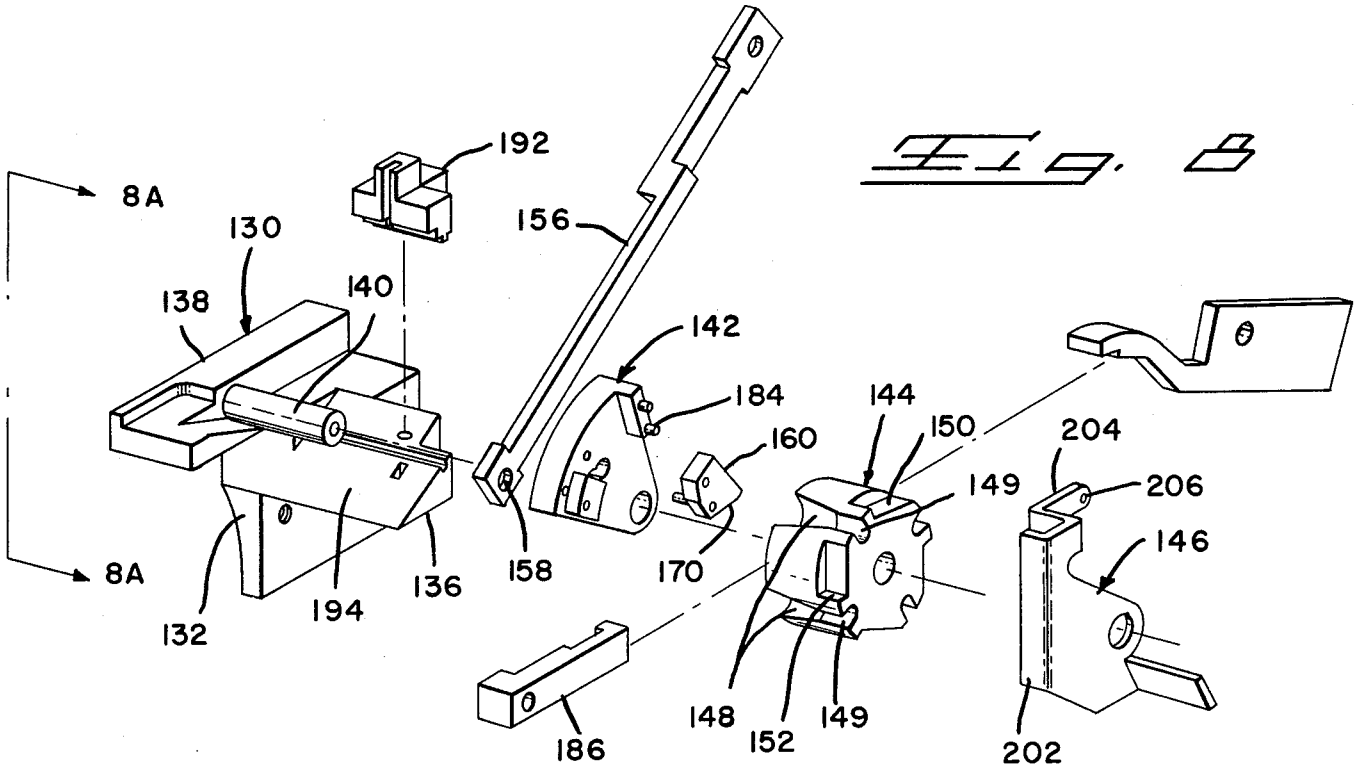
FIG. 8 is an exploded perspective view of the ejector wheel, the indexing means for the ejector wheel, and other associated structural features or elements.

As shown best in FIG. 8, the groove 18 in the surface 114 of the feed drum is formed in part by a slot 116 which extends through the surface and communicates with the circumferential recess 106. This portion of the groove has an end 120 and extends for a substantial distance along a straight line as seen in the developed view, FIG. 9, of the surface 114. The groove extends from this straight portion towards the right hand side 122 of the feed drum 16 and merges with this right hand side of the drum as shown at 123.

The purpose of the fixed ring 118 is illustrated in FIGS. 10 and 11; the ring extends inwardly beneath proportions of the groove 18 in which wires are conveyed laterally towards the side 122 of the feed drum. During such lateral conveyance of the wires, it is desirable to avoid the imposition of an axial feeding force component on the wires and the imposition of such an axial feeding component is minimized by virtue of the fact that the inner surface 126 of the groove is stationary and the coefficient of friction between the wire and this stationary surface is low. The portion of the groove 18 shown at 118 in which the wire is fed axially lies in the solid portion of the drum, that is rightwardly of the recess 106 as viewed in FIG. 3 so that the inner end 127 of this portion of the groove imparts an axial force component to the wire tending to feed it towards the operating zone of the apparatus. Advantageously, this surface 127 of the groove is roughened or otherwise treated to produce a high frictional coefficient. As will be explained below, a wire being fed is resiliently urged against the surface 127 by a pressure roll 210.

Figure 5:
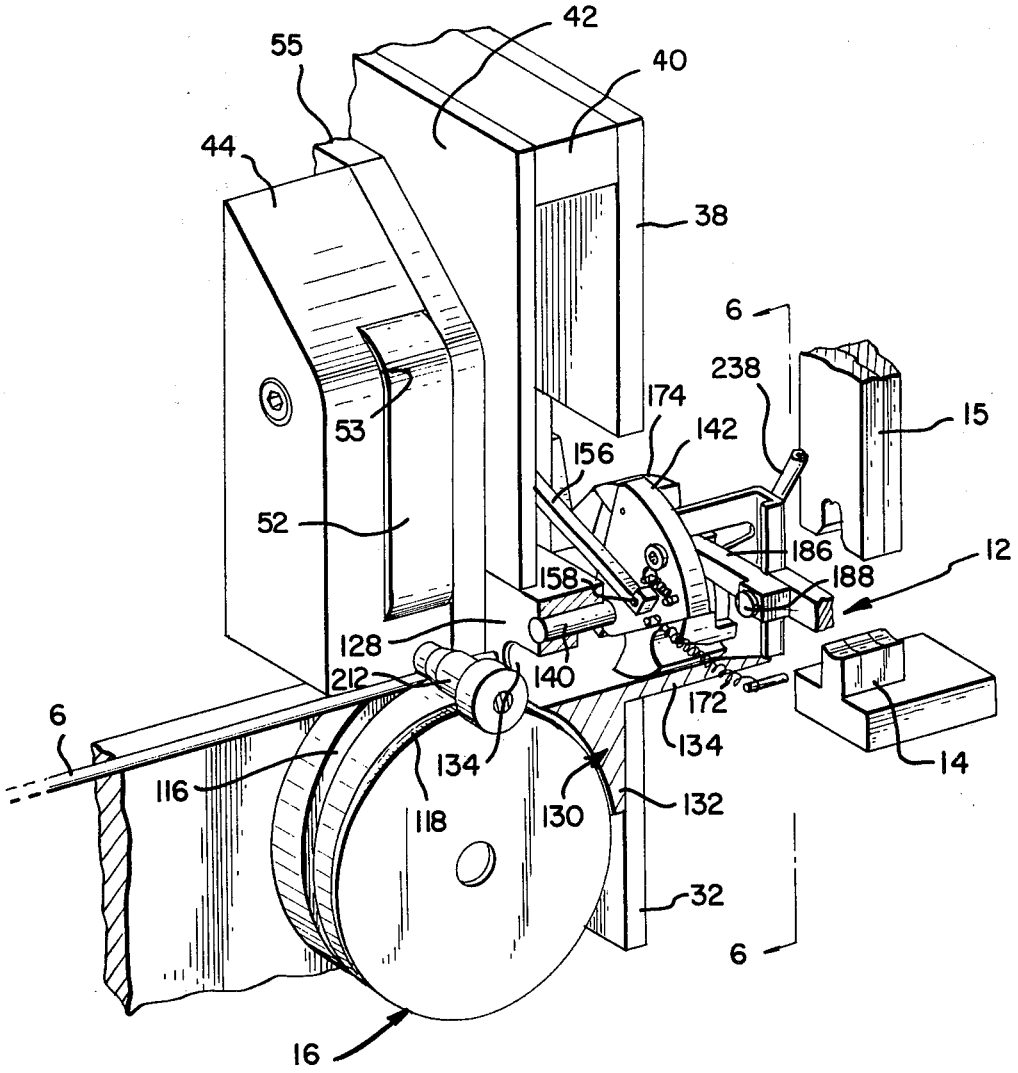
FIG. 5 is a fragmentary perspective view, with parts removed and broken away in places, looking from the right in FIG. 2, this view showing the wire conveying and feeding drum and portions of the operating zone of the apparatus.
Figure 8A:
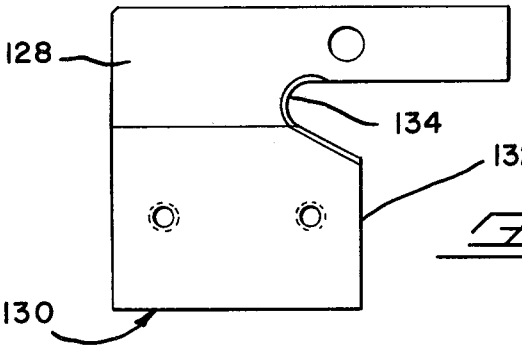
FIG. 8A is a frontal view of the block 130, looking in the direction of the arrows 8A—8A of FIG. 8.
Figure 12:
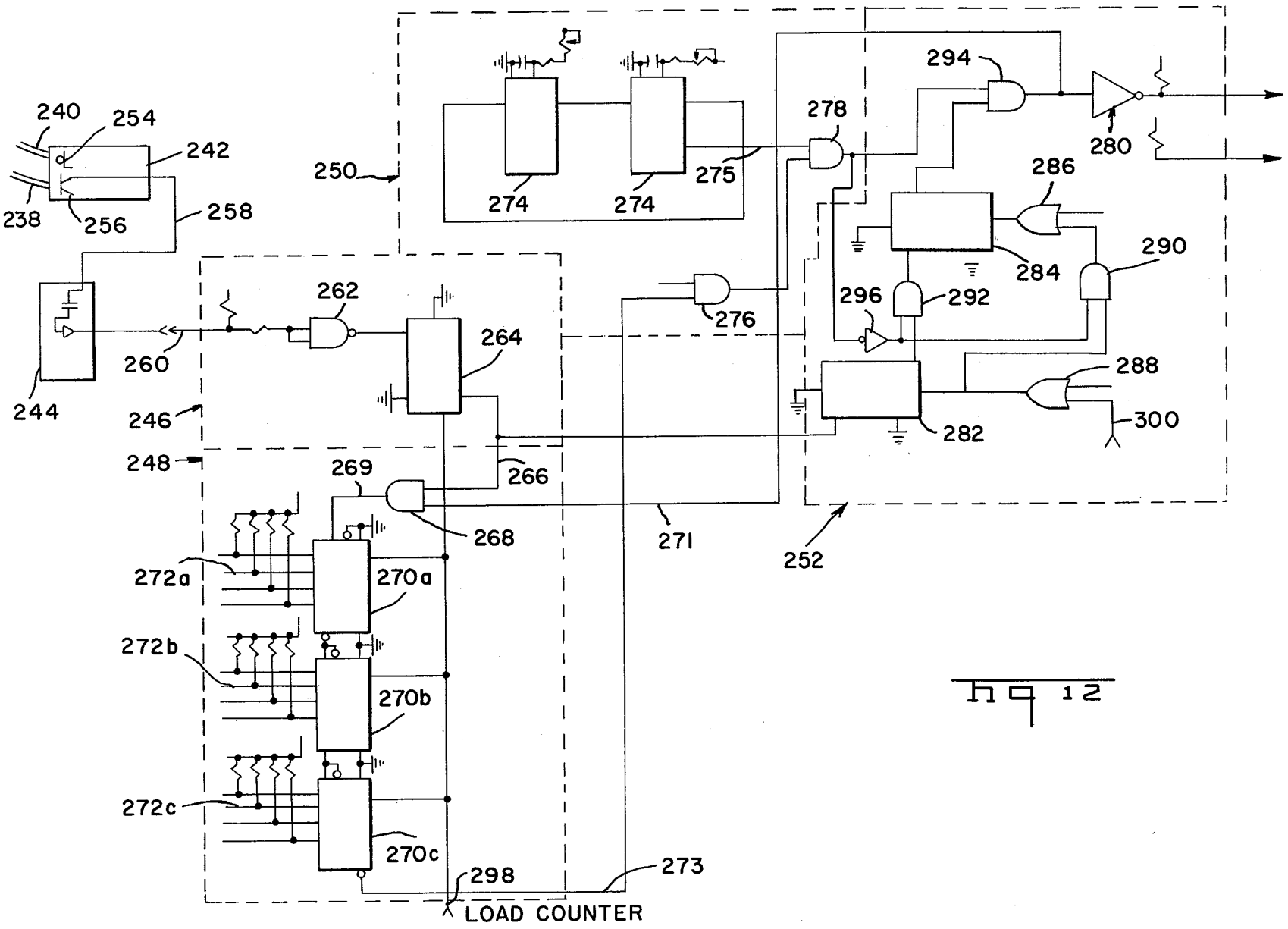
FIG. 12 is a diagram of a control circuit in accordance with the invention.

While the wires are being laterally conveyed from the loading station 8 to the axial feeding station 10, their leading ends bear against a surface 128 of an irregularly shaped block 130 (FIGS. 4, 5, and 8) which is mounted in a recess or notch in the plate 32 and which has portions adjacent to the feed wheel and the plate 32. This block 130 thus has a depending portion 132, a recess 134 which extends into the block from the right hand side thereof as viewed in FIG. 8A through which the wires are fed, and a rearwardly projecting section 136 which extends towards the crimping die and anvil 14, 15 as shown in FIGS. 5 and 8.

A pin 140 is mounted in the upper section 138 of the block 130 and extends parallel to the direction of wire feed towards the operating zone 12. This pin has mounted thereon an actuator sector 142, indexable ejector wheel 144 and a wire retainer plate 146. The sector, the ejector wheel, and the wire retainer serve to control a wire being fed towards the operating zone and to cause the ejection of a wire to which a terminal has been crimped as will be explained below.

Figure 6:
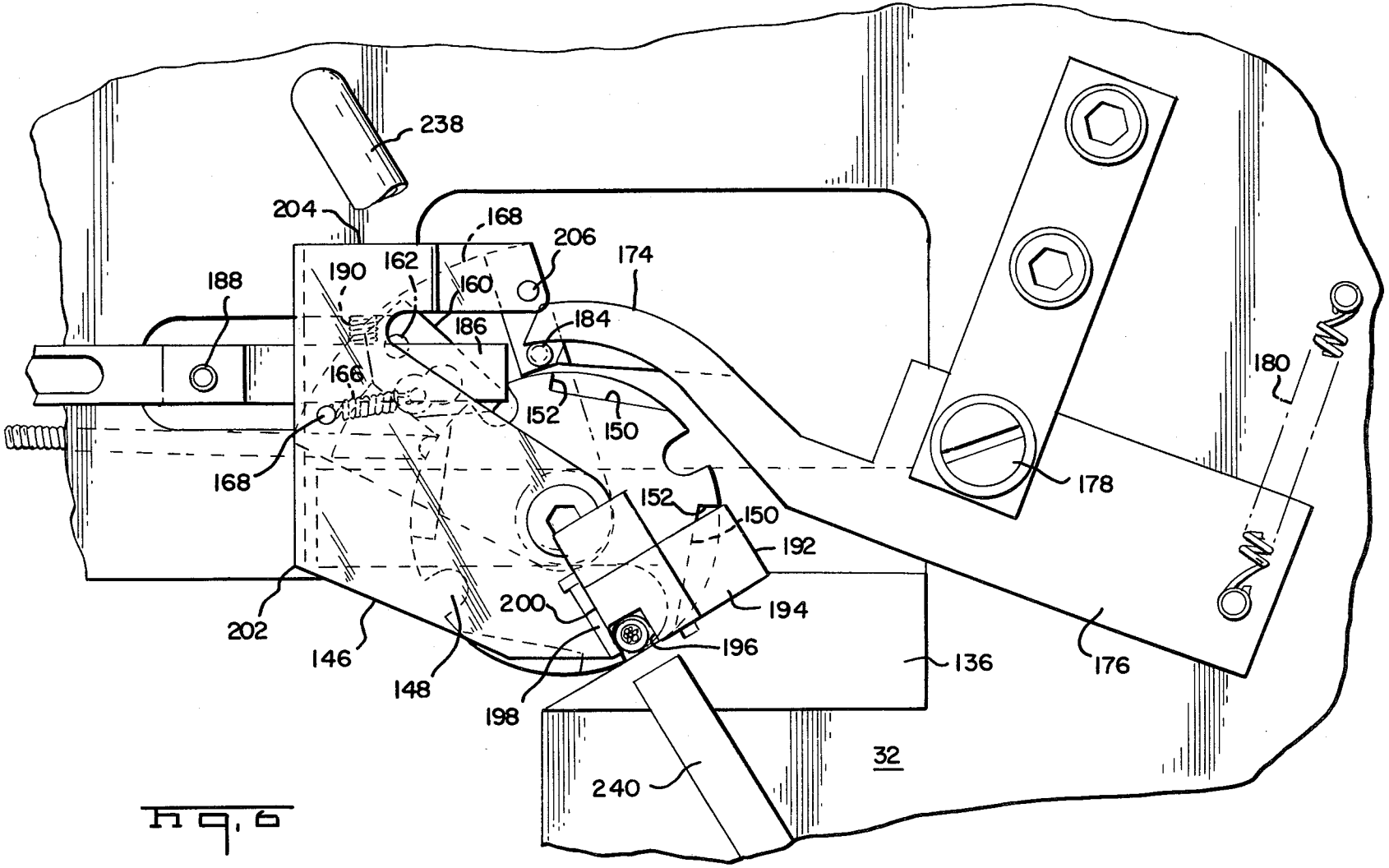
FIG. 6 is a view taken along the lines 6—6 of FIG. 5 showing particularly the ejection wheel for the wires and the means for indexing this ejector wheel, this view showing the normal positions of the parts.
Figure 7:
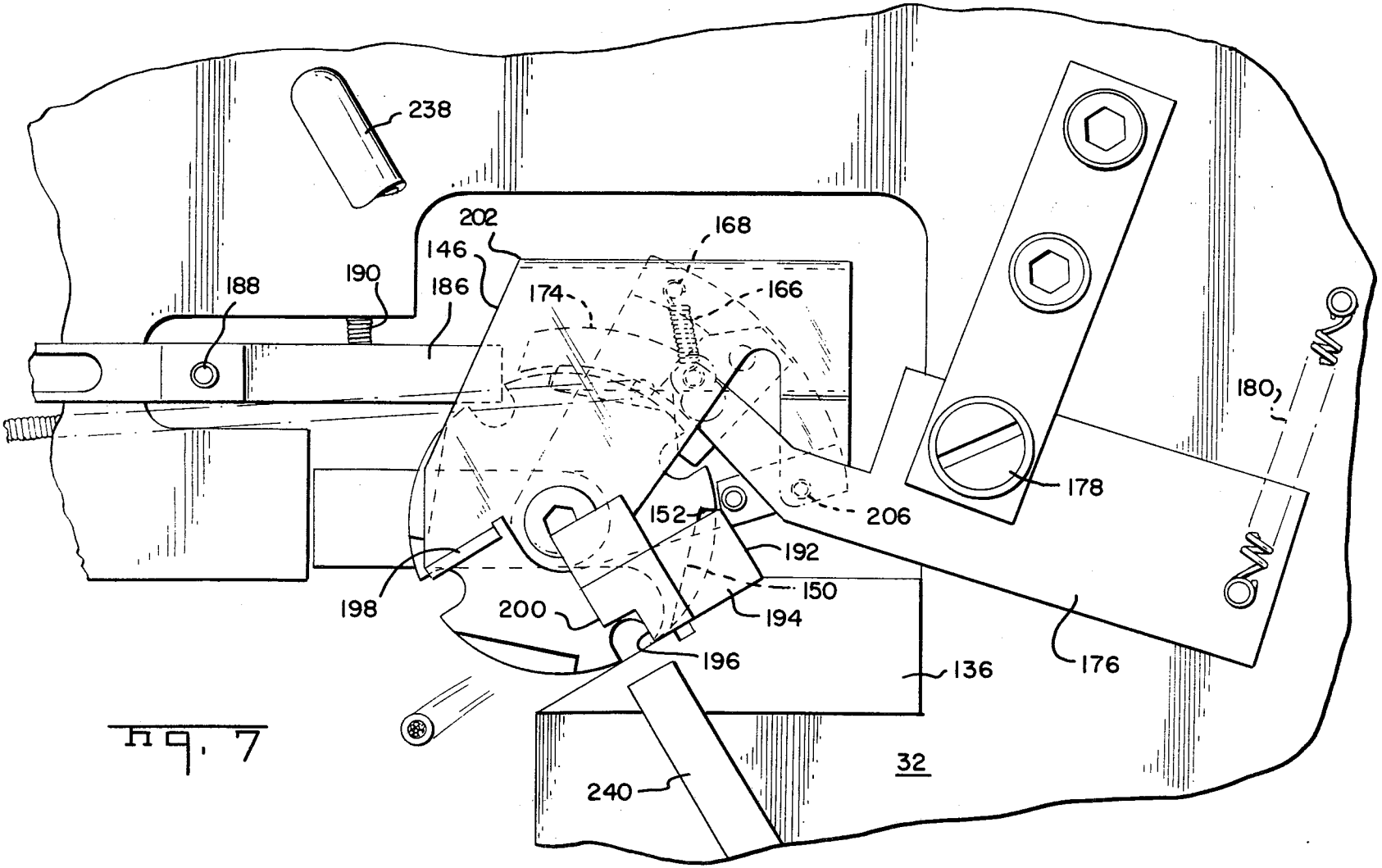
FIG. 7 is a view similar to FIG. 6 but showing the positions of the parts at a time close to the end of the operating cycle at which a terminated wire is ejected from the apparatus.

The indexable ejector wheel 144 is mounted between the sector 142 and the plate 146 and has four funnel-like recesses 148 extending axially through its surface at 90 degree intervals. Each recess 148 converges in the direction of wire feed and has a uniform diameter section 149 adjacent to the right hand end of the wheel as viewed in FIG. 4. The recess opens onto the cylindrical surface of the wheel to permit the wires to be ejected laterally of their axis during indexing the wheel as shown in FIGS. 6 and 7. Notches 150 are provided in the surface of the wheel between the recess 148 and each notch has a shoulder 152 which faces in a clockwise direction relative to the axis of the wheel as viewed in FIG. 6.

The wheel 144 and the wire retainer plate 146 are indexed during each operating cycle by the sector 142 which is oscillated relative to the axis of the pin 140 by a solenoid 4 (FIG. 2) which has an actuating member (not specifically shown) that is connected to the sector by a connecting rod 156 at a pivotal connection 158. The rearwardly facing surface of the sector, the surface which is against ejector wheel 144, has mounted thereon a pawl 160 by means of a pivotal connection 162 adjacent to the outer end of the sector. The pawl is resiliently biased in a clockwise direction as viewed in FIG. 6 by a spring 166 which is connected at one end thereof to a pin 167 which extends through an oversized slot in the sector. The other end of spring 166 is connected to a pin 168 mounted in the sector. The end of the pawl is contoured as shown at 170 such that it will enter the recesses 148 in the wheel and, during clockwise movement of the sector as viewed in FIG. 3, it will cause the wheel to be indexed in a clockwise direction. The end of the pawl is also designed such that it can move in a counterclockwise direction without effecting the wheel.

In order precisely to control the wheel 144, stops are provided to prevent overfeeding of the wheel and to prevent reverse motion of the wheel after it has been indexed. The anti-overfeed stop (FIG. 6) comprises an arcuate arm 174 on one end of a lever 176 which is pivoted intermediate its ends at 178 to the frame plate 32. Lever 176 is biased in a counterclockwise direction as viewed in FIG. 6 by a spring 180 which is secured by means of a pin to the right hand end of the lever and which is secured to its other end to a pin which is anchored in the plate 32. The arm 174 has a tooth 182 extending from its side which is adjacent to the surface of the wheel 144. This tooth is dimensioned to enter the notches 150 in the wheel and bear against the shoulders 152.

The sector 142 has a pin 184 extending towards the indexing wheel and this pin bears against the side of the arm 174 which is adjacent to the surface of the wheel 144. When the parts are at rest, that is, when they are in the positions of FIG. 6, the pin 184 maintains the arm 174 in the position of FIG. 6 in which it is spaced from the indexing wheel. As the sector moves through its clockwise arc from the position of FIG. 6 to the position of FIG. 7, the pin 184 moves out of engagement with the arm 174 so that the tooth moves into the notch 150 which is proximate to the end of the arm as shown in FIG. 7. The shoulder 152 moves against the toothe and the wheel 144 is thus stopped from further rotary movement at a precisely predetermined position. When the sector 142 then moves through a counterclockwise arc to its normal position (FIG. 6) it raises the arm 174 and disengages the tooth from the notch 150.

Counterclockwise movement of the wheel 144 is prevented by a stop on the end of an arm 186 which is pivotally mounted at 188 on the left hand side of the indexing wheel as viewed in FIG. 6. Arm 186 is biased in a clockwise direction by a spring 190 and the end of the arm is dimensioned to enter the recesses 148 as shown in FIG. 6 such that counterclockwise movement of the indexing wheel is prevented while clockwise movement of the indexing wheel can take place with accompanying deflection of arm 186.

As shown in FIGS. 4, 6, and 8 the rightwardly extending portion 136 of the block 134 has an inclined surface 194 which extends generally tangentially with respect to the indexing wheel so that the surface of the wheel is close to the inclined surface of the block. An L-shaped guide block 192 is secured to a suitable fastener to the inclined surface 194 and the corner of this block is provided with a notch 196 (FIG. 6) which is in alignment with the axis of the recess 148 which is adjacent to the inclined surface. A passageway for a wire being fed is defined by this notch and by a retaining arm 198 which extends forwardly, that is towards the operating zone, from the previously identified wire retainer plate 146. Plate 146 is mounted on the pin 140 and against the end of the indexing wheel. The arm 198 is disposed against the open side of the notch 196 when the plate 146 is in the position of FIG. 6. The plate 146 has a flange 202 extending from the outer end and an arm 204 extends rightwardly from upper end of the plate as viewed in FIG. 6. The end of this arm is pivotally connected at 206 to the sector 142 so that when the sector is oscillated as previously described, the plate 146 and, therefore, the arm 198 moves with the sector.

As will be apparent from a comparison of FIGS. 6 and 7, after a terminal has been crimped onto wire in the operating zone, the indexing wheel is indexed through an angle of 90 degrees and after the recess in which the wire is held moves away from the inclined surface 194 the terminated wire is free to fall from the indexing wheel as shown in FIG. 7.

As mentioned above, during the wire feeding step, the wire in the groove 18 at the feeding station is resiliently urged against the inner end of the groove in order to impart a feeding which is component to the wire. To this end, a pressure wheel 210 (FIG. 3) is provided immediately above the upper end of the drum 16 at the wire feeding station. This pressure wheel is mounted on a shaft 218 which extends parallel to the shaft 94 and it has an intermediate cylindrical portion 212 which is adapted to engage the wire being fed. This intermediate cylindrical portion merges with a conical surfaced 214 which in turn merges with a cylindrical portion 216 of reduced diameter. By virtue of the reduced diameter portion and the cylindrical and conical portion 214, the wires can be conveyed rightwardly until they are in the right hand portion of the groove 18 and beneath the cylindrical feed portion 212 of the idler roll.

The shaft 218 on which roll 210 is mounted is carried in the lower end of an L-shaped block 220 which is slidably contained in a housing 222 that is mounted on the plate 42. A rod 226 extends upwardly from the block 220 and a spring 224 surrounds the rod and biases the block downwardly. The normal position of the block 220 is such that the roll 210 is in feeding relationship to a wire in the groove 18. During intervals when wires are not being fed, the rod 226 is moved upwardly against the biasing force of the spring 224 to disengage the roll from the wire. Upward movement of the rod 226 is brought about by a solenoid 234 which is mounted on the plate 32 and which has an actuator rod extending therefrom coupled to the right hand end as viewed in FIG. 2 of a lever 228. The left hand end of this lever has a lost motion pin-slot connection 227 with the upper end of the rod 226 and the lever is pivotally mounted on the plate 42 intermediate its ends as shown at 230. It will thus be apparent that upon energizing the solenoid 234, the rod 226 will be moved upwardly to disengage the feed roll or to move the feed roll to its non-feeding position.

It will be apparent that the axial feeding of the individual wires into the operating zone must be precisely controlled so that the ends of the wires will be properly located between the die and anvil and in alignment with the terminal disposed on the anvil. Such precise feeding of the wire is accomplished by a control system for the stepping motor 104 which causes this motor to rotate through a precisely determined arc after the wire passes a predetermined position during the wire feeding step. Specifically, as the wire moves through the block 192, it interrupts a beam of light which extends between the ends of two fibre-optic conductors 238, 240. The upper fibre-optic light conductor 238 extends into the block 192 and is in alignment with the lower light conductor 240 as shown best in FIG. 4. The light beam transmitted by these fibre-optic light conductors intersects the path of wire feed and when this light beam is interrupted by a wire being fed, the stepping motor is rotated through a precisely determined arc to feed the wire by the distance which separates the axis of the fibre-optic conductors and the terminal which is positioned on the anvil. This control system for the stepping motor is described below.

The stepping motor control system comprises an emmitter/sensor block 242, an amplifier 244, a wire sense latch and counter enable 246, a counter 248, a clock 250, and a motor control board interface 252 which is connected to the control board for the motor. The control board and the stepping motor may be of any suitable commercially available model, for example, good results have been obtained using a Superior Electric MO63-FC06 stepping motor in combination with a Superior Electric control board model STM1800D. This control board and motor are available from Superior Electrical Company of Bristol, Conn.

The emmitter/sensor block 242 serves to sense the absence of, or the partial interruption of, the light transmitted through the fibre-optic conductors 238, 240. The interruption takes place when the leading end of a wire passes between these two conductors as illustrated in FIG. 4. This sensor block 242 thus comprises an incandescent light source 254 from which the light transmitted through the conductor eminates and a photo transistor 256 which responds to the interruption of the light source and sends forth a signal through a line 258 to the amplifier 244. The emmitter/sensor block may be, for example, a Scan-A-Matic model SO1116.

The amplifier 244 is of the AC-coupled type and amplifies the pulse from the emitter/sensor block 242 before it passes through a line 260 to the sense latch and counter enable 246. This sense latch comprises a Schmitt trigger 262 which may be an RCA part number CD4093 and which serves to shape the pulse before it is transmitted to a clock D-type flip-flop 264 which stores the pulse during the interval of measuring the wire feed, that is, while the wire is being fed from a location between the fibre-optic conductors to its final positions as shown in FIG. 4. The flip-flop may be of a type manufactured by the Radio Corporation of America and sold commercially as part number CD4013.

The flip-flop 264 is connected by a wire sense signal line 266 to an AND gate 268 and to the flip-flop 282 which serves as an enabling means to cause the motor driving circuitry to begin the wire measuring counts, as described below, provided the press ready signal is high (i.e. the press is in a state of readiness for the crimping operation). It should be mentioned at this point that if the press ready signal is low, that is, if the press is not in a state of readiness but is in the process of completing its previous operating cycle, the stepping motor will be stopped momentarily when the light beam is interrupted to permit the press to complete its previous operating cycle and the wire will thereafter be fed into the operating zone. The circuitry for stopping the stepping motor under these circumstances will be described below.

The AND gate 268 is connected as shown at 269 to cascaded counters **270*a*, 270*b*, 270*c* which can be set for a given number of counts by thumbwheel switches 272*a*, 272*b*, and 272*c* respectively. The counters may be of the type sold by Radio Corporation of America part number CD4029. The AND gate 268 is connected as shown in 271 to the clock output which in turn controls the continuous operation of the motor. The counter 270*c* is connected as shown at 273 to AND gates 276, 278, the gate 278 also being connected as shown at 275 to the clock 250. The clock 250 serves to supply pulses to the Superior Electric motor control board model STM 1800D (not shown) and comprises two multivibrator circuits 274** which form an astable multi-vibrator.

The crimping press 20 requires a significant time interval to complete its cycle of operation when a fed wire is located between the die and anvil 14, 15 and, depending upon the length of this time interval, the wire being fed to the operating zone may arrive at its final location prior to completion of the previous operation cycle of the crimping press. Under such circumstances, the crimping press will not be in a state of readiness and the signal for actuating the press must be delayed until the previous cycle has been completed as mentioned above. The control system for the apparatus, therefore, contains means for synchronizing the wire feeding operation with the operation of the crimping press and, when necessary, delaying the transmission of the signal to the press to commence its operating cycle until the previous cycle has been completed. In the disclosed embodiment, this synchronization means is provided in the motor control board interface 252 and comprises flip-flops 282, 284, OR gates 286, 288, AND gates 290, 292, 294, and an AND inverter 296. These components may be of any suitable commercially available type, for example, the flip-flops 282, 284 may be RCA part number CD4013, the OR gates 286, 288 may be RCA part number CD4071, the AND gates 290, 292, 294 may be RCA part number CD4081 and the AND inverter 296 RCA part number CD4049.

Synchronization is achieved by monitoring a press ready signal which is transmitted from the press to the OR gate 288 and simultaneously monitoring the wire sense signal on line 266. The press ready signal can be derived in any suitable manner from the control circuitry for the press. For example, if the press is of the conventional type having a continuously rotating fly wheel and a single revolution clutch which is engaged with the shaft when the press is cycled, the signal can be obtained by providing a suitable switch on the shaft which is closed after the shaft has completed a single revolution. Alternatively, the press may be provided with a timing circuit which is designed to control the operation of the press including the mechanism for feeding the terminal strip, and which will produce a low logic level signal while the press ram is moving and a high logic level signal when the press ram comes to rest after the completion of an operating cycle. The disclosed embodiment has a timing circuit for the press which produces low and high logic level signals through the line 300 to the motor control board interface 252 as described below.

When the presence of the end of the wire is signaled through line 266, the stepping motor is stopped if the machine ready signal is low as monitored by the flip-flop 282 and OR gate 288. The low signal, of course, indicates that the crimping press is not in a state of readiness to perform the crimping operation on the wire. Under such circumstances, the clock output is gated off by the AND gate 294 only when the clock is in the low state. The clock low condition is sensed by the AND inverter 296, the AND gate 292, and the flip-flop 284. This gating off prevents a clock high pulse being cut short or chopped so that the counters 270a, 270b, and 270c are decremented but the stepping motor does not step because of the short pulse width. The motor is restarted when the machine ready signal at OR gate 288 is high to indicate that the press is now in a state of readiness for its operating cycle.

The foregoing explanation assumes that the press is not in a state of readiness when the wire interrupts the light beam. If the press is in a state of readiness when the end of the wire is sensed, the stepping motor will not be stopped and the wire will be fed without interruption into the operating zone of the press.

When the counter zero signal is transmitted through 273 to the AND gate 276 and the AND gate 278, the clock output ceases and the motor stops. The output from the gate 278 is fed through the AND gate 294 to a CMOS-to-high-current driver 280 which may be of the type sold by Sprague Electric part number ULN 2004. The multi-vibrator circuits 274 may be of the type sold by RCA, part number CD4098 and the AND gates 276, 278 and may be of the type sold by RCA part number CD4081.

To summarize, when the light transmitted through the fibre-optic conductors 238, 240 is interrupted by the leading end of a wire, the emmitter/sensor block 242 in combination with the amplifier 244 provides a pulse through line 260 to the wire sense latch 246. Upon receipt of this pulse the counter is enabled and the wire measuring sequence is started provided the crimping machine is ready. The motor rotates by an amount determined in the setting of the thumb-wheel switches *272a–272c* and when the counters are fully decremented, a zero signal is transmitted to the gates 276, 278 which has the effect of stopping the clock and, therefore, stopping the motor.

The zero signal functions as a start signal to the other circuitry which controls the functions of crimping the terminal on the wire, feeding the terminal, and ejecting the terminated lead. This circuitry then sends the load counters signal back to the motor control system through line 298 which restarts the stepping motor. The machine ready signal functions as a synchronization signal as explained above.

The disclosed system has the advantage of being extremely sensitive to the wire when the leading end of the wire interrupts the light beam which extends between the adjacent ends of the fibre-optic conductors 238, 240 in the block 192. Advantageously, these conductors comprise bundles of glass fibers which are bunched to form a cable having a rectangular cross section, the dimensions of this cross section being about 0.125 inches by 0.010 inches. If the leading end of the wire interrupts as little as 25 percent of the light beam transmitted between the ends of these conductors, the disturbance will be sufficient to cause a signal to be sent through the line 258 to the amplifier 244 and, thereby, start the wire measuring sequence.

It will be apparent from the foregoing description that during continuous operation of the apparatus, the operator simply stacks stripped leads 6 in the vertical slot 48 and the machine transports the leads from the slot to the crimping station and ejects them into a suitable retaining bin formed in the cover as shown in FIG. 1. The operation of stacking the leads in the slot does not require a high degree of skill and does not require precise location of the wires since the upper ends of the blocks are provided with inclined surfaces to guide the wires into the slot. The machine can operate at speeds in excess of four thousand leads per hour and an operator has no difficulty in placing wires in the slot at a rate sufficient to keep the conveyor supplied with wires.

The invention has herein been disclosed in conjunction with the lead making machine shown in the drawing for the reason that this machine requires precise, accurate, and reliable feeding of the wire and thereby demonstrates some of the advantages of the invention. It is to be understood that the principles of the invention can be used for intermittently feeding materials other than wire, such as strip metal in other types of machines. For example, if it is desired to feed strip metal through a shearing apparatus which shears the metal strip into discrete lengths, the material can be fed past the shearing blades by the required amount by means of a feeding apparatus in accordance with the invention. The outstanding feature of the invention is the fact that the end of the material being fed is detected and the precise feeding which takes place after detection of the end ensures that the end will be precisely located after the feeding step has been completed.

What is claimed is:

1. In combination with an apparatus having an operating zone and having a cyclically operating means in said zone for performing an operation, such as crimping a terminal, onto one end of a wire, feeding means for feeding a wire axially into said zone and positioning the end of said wire at a precise location in said zone, said feeding means comprising:

feed roll means, a stepping motor coupled to said feed roll means to drive said feed roll means and feed said wire along a feed path which extends towards said operating zone to said precise location, wire sensing means on said path for sensing the presence of the leading end of said wire during feeding of said wire, said wire sensing means being spaced from said predetermined location by a predetermined distance, control means for said stepping motor, said control means comprising pulse generating means for generating a predetermined number of pulses for supply to said stepping motor for rotating said stepping motor by an amount sufficient to said feed wire from said sensing means to said predetermined location, counting means for counting pulses supplied to said motor, means responsive to said counting means for stopping said motor after said predetermined number of pulses have been supplied to said motor, selective switch means for selectively determining said predetermined number of pulses, and readiness indicating means responsive to said cyclically operating means, said readiness indicating means being effective to sense the readiness of said operating means to perform said operation and being effective to delay feeding of said wire to said predetermined location until said operating means completes a previous cycle of operation and is in a state of readiness to perform said operation.

2. Apparatus as set forth in claim 1, said sensing means comprising a light beam directed transversely of said path and light sensing transistor means effective to sense interruption of said light beam by said leading end of said wire.

3. Apparatus as set forth in claim 2, said operating means comprising a terminal crimping press having a crimping die and anvil, said readiness indicating means being effective to delay feeding of said wire at said light beam when said press is not in a state of readiness to crimp a terminal onto said wire.

* * * * *